US009837094B2

(12) United States Patent
Subasingha et al.

(10) Patent No.: US 9,837,094 B2
(45) Date of Patent: Dec. 5, 2017

(54) SIGNAL RE-USE DURING BANDWIDTH TRANSITION PERIOD

(71) Applicant: QUALCOMM Incorporated, San Diego, CA (US)

(72) Inventors: Subasingha Shaminda Subasingha, San Diego, CA (US); Venkatraman Atti, San Diego, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/174,843

(22) Filed: Jun. 6, 2016

(65) Prior Publication Data

US 2017/0053659 A1 Feb. 23, 2017

Related U.S. Application Data

(60) Provisional application No. 62/206,777, filed on Aug. 18, 2015.

(51) Int. Cl.

| | |
|---|---|
| ***G10L 19/16*** | (2013.01) |
| ***G10L 19/005*** | (2013.01) |
| ***G10L 19/07*** | (2013.01) |
| ***G10L 19/087*** | (2013.01) |
| *G10L 19/24* | (2013.01) |
| *G10L 21/038* | (2013.01) |

(52) U.S. Cl.

CPC ..... *G10L 19/167* (2013.01); *G10L 19/005* (2013.01); *G10L 19/07* (2013.01); *G10L 19/087* (2013.01); *G10L 19/24* (2013.01); *G10L 21/038* (2013.01)

(58) Field of Classification Search

CPC ..... G10L 19/167; G10L 19/07; G10L 19/087; G10L 19/005; G10L 19/24; G10L 21/038

See application file for complete search history.

(56) References Cited

U.S. PATENT DOCUMENTS 6,931,292 B1 * 8/2005 Brumitt ..... G10L 21/0208 381/94.3
2008/0249766 A1 10/2008 Ehara
2015/0162008 A1 6/2015 Villette et al.

OTHER PUBLICATIONS

Laaksonen L, "Artificial Bandwidth Extension of Narrowband Speech—Enhanced Speech Quality and Intelligibility in Mobile Device," May 3, 2013 (May 3, 2013), pp. 1-100, XP055301814, Aalto University ISBN: 978-952-6051-25-3 Retrieved from the Internet: URL:http://lib.tkk.fi/Diss/2013/isbn9789526051253/isbn9789526051253.pdf [retrieved on Sep. 12, 2016].

(Continued)

*Primary Examiner* — Qian Yang
(74) *Attorney, Agent, or Firm* — Toler Law Group, PC

(57) ABSTRACT

A method includes determining an error condition during a bandwidth transition period of an encoded audio signal. The error condition corresponds to a second frame of the encoded audio signal, where the second frame sequentially follows a first frame in the encoded audio signal. The method also includes generating audio data corresponding to a first frequency band of the second frame based on audio data corresponding to the first frequency band of the first frame. The method further includes re-using a signal corresponding to a second frequency band of the first frame to synthesize audio data corresponding to the second frequency band of the second frame.

42 Claims, 7 Drawing Sheets

(56) References Cited

OTHER PUBLICATIONS

Partial International Search Report—PCT/US2016/039396—ISA/EPO—dated Sep. 27, 2016.
STA CR Phane Ragot France Telecom France: AAP35-LC-G.729.1-new-TD0260-plen rev2H, ITU-T DRAFT ; Study Period 2005-2008, International Telecommunication Union, Geneva ; CH, vol. Study Group 16, Jun. 28, 2006 (Jun. 28, 2006), pp. 1-95, XP017543883, [retrieved on Jun. 28, 2006].
Geiser, Bernd, et al., "A Qualified ITU-T G.729EV Codec Candidate for Hierarchical Speech and Audio Coding," IEEE Workshop on Multimedia Signal Processing, Oct. 3-6, 2006, IEEE, Piscataway, NJ, pp. 114-118.

* cited by examiner

SIGNAL RE-USE DURING BANDWIDTH TRANSITION PERIOD

I. CROSS-REFERENCE TO RELATED APPLICATIONS

The present application claims priority from commonly owned U.S. Provisional Patent Application No. 62/206,777 filed on Aug. 18, 2015 and entitled "SIGNAL RE-USE DURING BANDWIDTH TRANSITION PERIOD," the content of which is expressly incorporated herein by reference in its entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

Transmission of voice by digital techniques is widespread, particularly in long distance and digital radio telephone applications. There may be an interest in determining the least amount of information that can be sent over a channel while maintaining a perceived quality of reconstructed speech. If speech is transmitted by sampling and digitizing, a data rate on the order of sixty-four kilobits per second (kbps) may be used to achieve a speech quality of an analog telephone. Through the use of speech analysis, followed by coding, transmission, and re-synthesis at a receiver, a significant reduction in the data rate may be achieved.

Devices for compressing speech may find use in many fields of telecommunications. An exemplary field is wireless communications. The field of wireless communications has many applications including, e.g., cordless telephones, paging, wireless local loops, wireless telephony such as cellular and personal communication service (PCS) telephone systems, mobile IP telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a CDMA system. The IS-95 standard and its derivatives, IS-95A, American National Standards Institute (ANSI) J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems.

The IS-95 standard subsequently evolved into "3G" systems, such as cdma2000 and wideband CDMA (WCDMA), which provide more capacity and high speed packet data services. Two variations of cdma2000 are presented by the documents IS-2000 (cdma2000 1×RTT) and IS-856 (cdma2000 1×EV-DO), which are issued by TIA. The cdma2000 1×RTT communication system offers a peak data rate of 153 kbps whereas the cdma2000 1×EV-DO communication system defines a set of data rates, ranging from 38.4 kbps to 2.4 Mbps. The WCDMA standard is embodied in 3rd Generation Partnership Project (3GPP), Document Nos. 3G TS 25.211, 3G TS 25.212, 3G TS 25.213, and 3G TS 25.214. The International Mobile Telecommunications Advanced (IMT-Advanced) specification sets out "4G" standards. The IMT-Advanced specification sets peak data rate for 4G service at 100 megabits per second (Mbit/s) for high mobility communication (e.g., from trains and cars) and 1 gigabit per second (Gbit/s) for low mobility communication (e.g., from pedestrians and stationary users).

Devices that employ techniques to compress speech by extracting parameters that relate to a model of human speech generation are called speech coders. Speech coders may comprise an encoder and a decoder. The encoder divides the incoming speech signal into blocks of time, or analysis frames. The duration of each segment in time (or "frame") may be selected to be short enough that the spectral envelope of the signal may be expected to remain relatively stationary. For example, one frame length is twenty milliseconds, which corresponds to 160 samples at a sampling rate of eight kilohertz (kHz), although any frame length or sampling rate deemed suitable for the particular application may be used.

The encoder analyzes the incoming speech frame to extract certain relevant parameters, and then quantizes the parameters into binary representation, e.g., to a set of bits or a binary data packet. The data packets are transmitted over a communication channel (i.e., a wired and/or wireless network connection) to a receiver and a decoder. The decoder processes the data packets, unquantizes the processed data packets to produce the parameters, and resynthesizes the speech frames using the unquantized parameters.

The function of the speech coder is to compress the digitized speech signal into a low-bit-rate signal by removing natural redundancies inherent in speech. The digital compression may be achieved by representing an input speech frame with a set of parameters and employing quantization to represent the parameters with a set of bits. If the input speech frame has a number of bits Ni and a data packet produced by the speech coder has a number of bits No, the compression factor achieved by the speech coder is Cr=Ni/No. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of No bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (e.g., 5 millisecond (ms) sub-frames) at a time. For each sub-frame, a high-precision representative from a codebook space is found by means of a search algorithm. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

One time-domain speech coder is the Code Excited Linear Prediction (CELP) coder. In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, No, for each frame) or at a variable rate (in which different bit rates are used for different types of frame contents). Variable-rate coders attempt to use the amount of bits needed to encode the codec parameters to a level adequate to obtain a target quality.

Time-domain coders such as the CELP coder may rely upon a high number of bits, No, per frame to preserve the accuracy of the time-domain speech waveform. Such coders may deliver excellent voice quality provided that the number of bits, No, per frame is relatively large (e.g., 8 kbps or above). At low bit rates (e.g., 4 kbps and below), time-domain coders may fail to retain high quality and robust performance due to the limited number of available bits. At low bit rates, the limited codebook space clips the waveform-matching capability of time-domain coders, which are deployed in higher-rate commercial applications. Hence, despite improvements over time, many CELP coding systems operating at low bit rates suffer from perceptually significant distortion characterized as noise.

An alternative to CELP coders at low bit rates is the "Noise Excited Linear Prediction"(NELP) coder, which operates under similar principles as a CELP coder. NELP coders use a filtered pseudo-random noise signal to model speech, rather than a codebook. Since NELP uses a simpler model for coded speech, NELP achieves a lower bit rate than CELP. NELP may be used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal.

There may be research interest and commercial interest in improving audio quality of a speech signal (e.g., a coded speech signal, a reconstructed speech signal, or both). For example, a communication device may receive a speech signal with lower than optimal voice quality. To illustrate, the communication device may receive the speech signal from another communication device during a voice call. The voice call quality may suffer due to various reasons, such as environmental noise (e.g., wind, street noise), limitations of the interfaces of the communication devices, signal processing by the communication devices, packet loss, bandwidth limitations, bit-rate limitations, etc.

In traditional telephone systems (e.g., public switched telephone networks (PSTNs)), signal bandwidth may be limited to the frequency range of 300 Hertz (Hz) to 3.4 kHz. In wideband (WB) applications, such as cellular telephony and voice over internet protocol (VoIP), signal bandwidth may span the frequency range from 50 Hz to 7 (or 8) kHz. Super wideband (SWB) coding techniques support bandwidth that may extend up to around 16 kHz, and full band (FB) coding techniques support bandwidth that may extend up to around 20 kHz. Extending signal bandwidth from narrowband (NB) telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 0 Hz to 6.4 kHz, which may be referred to as the "low-band"). For example, the low-band may be represented using filter parameters and/or a low-band excitation signal. However, in order to improve coding efficiency, the higher frequency portion of the signal (e.g., 6.4 kHz to 16 kHz, which may be referred to as the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc. When decoding an encoded signal, unwanted artifacts may be introduced in certain conditions, such as when one or more frames of the encoded signal exhibit an error condition.

IV. SUMMARY

In a particular aspect, a method includes determining, at an electronic device during a bandwidth transition period of an encoded audio signal, an error condition corresponding to a second frame of the encoded audio signal. The second frame sequentially follows a first frame in the encoded audio signal. The method also includes generating audio data corresponding to a first frequency band of the second frame based on audio data corresponding to the first frequency band of the first frame. The method further includes re-using a signal corresponding to a second frequency band of the first frame to synthesize audio data corresponding to the second frequency band of the second frame.

In another particular aspect, an apparatus includes a decoder configured to generate, during a bandwidth transition period of an encoded audio signal, audio data corresponding to a first frequency band of a second frame of the encoded audio signal based on audio data corresponding to the first frequency band of a first frame of the encoded audio signal. The second frame sequentially follows the first frame in the encoded audio signal. The apparatus also includes a bandwidth transition compensation module configured, in response to an error condition corresponding to the second frame, to re-use a signal corresponding to a second frequency band of the first frame to synthesize audio data corresponding to the second frequency band of the second frame.

In another particular aspect, an apparatus includes means for generating, during a bandwidth transition period of an encoded audio signal, audio data corresponding to a first frequency band of a second frame of the encoded audio signal based on audio data corresponding to the first frequency band of a first frame of the encoded audio signal. The second frame sequentially follows the first frame in the encoded audio signal. The apparatus also includes means, responsive to an error condition corresponding to the second frame, for re-using a signal corresponding to a second frequency band of the first frame to synthesize audio data corresponding to the second frequency band of the second frame.

In another particular aspect, a non-transitory processor-readable medium includes instructions that, when executed by a processor, cause the processor to perform operations including determining, during a bandwidth transition period of an encoded audio signal, an error condition corresponding to a second frame of the encoded audio signal. The second frame sequentially follows a first frame in the encoded audio signal. The operations also include generating audio data corresponding to a first frequency band of the second frame based on audio data corresponding to the first frequency band of the first frame. The operations further include re-using a signal corresponding to a second frequency band of the first frame to synthesize audio data corresponding to the second frequency band of the second frame.

In another particular aspect, a method includes determining, at an electronic device during a bandwidth transition period of an encoded audio signal, an error condition corresponding to a second frame of the encoded audio signal. The second frame sequentially follows a first frame in the encoded audio signal. The method also includes generating audio data corresponding to a first frequency band of the second frame based on audio data corresponding to the first frequency band of the first frame. The method further includes determining, based on whether the first frame is an algebraic code-excited linear prediction (ACELP) frame or a non-ACELP frame, whether to perform high-band error concealment or re-use a signal corresponding to a second frequency band of the first frame to synthesize audio data corresponding to the second frequency band of the second frame.

V. BRIEF DESCRIPTION OF THE DRAWINGS

VI. DETAILED DESCRIPTION

Figure 1:
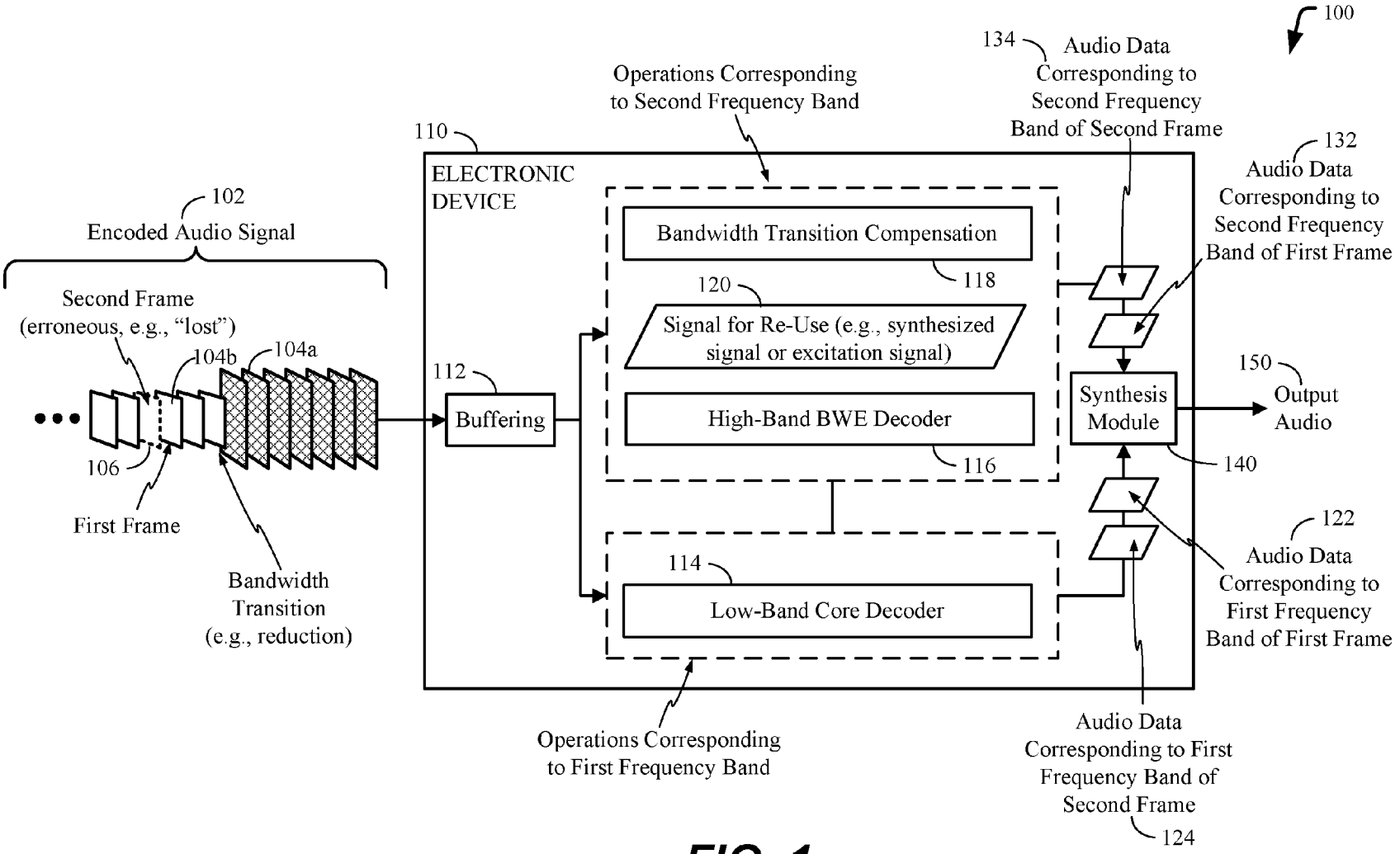
FIG. 1 is a diagram to illustrate a particular aspect of a system that is operable to perform signal re-use during a bandwidth transition period.

Some speech coders support communication of audio data in accordance with multiple bitrates and multiple bandwidths. For example, the Enhanced Voice Services (EVS) coder/decoder (CODEC), which is developed by 3GPP for use with Long Term Evolution (LTE)-type networks, may support NB, WB, SWB, and FB communication. When multiple bandwidths (and bitrates) are supported, encoding bandwidth may change in the middle of the audio stream. A decoder may perform a corresponding switch upon detecting the change in bandwidth. An abrupt bandwidth switch at the decoder, however, may result in audio artifacts that are noticeable to a user, thereby degrading audio quality. Audio artifacts may also result when a frame of the encoded audio signal is lost or is corrupted.

To reduce the presence of artifacts due to a lost/corrupt frame, the decoder may perform error concealment operations, such as replacing data of the lost/corrupt frame with data that is generated based on a previously received frame or based on pre-selected parameter values. To reduce the presence of artifacts due to an abrupt bandwidth transition, the decoder may gradually adjust an energy of the frequency region that corresponds to the bandwidth transition after detecting the bandwidth transition in an encoded audio signal. To illustrate, if the encoded audio signal transitions from SWB (e.g., encoding a 16 kHz bandwidth corresponding to a frequency range from 0 Hz to 16 kHz) to WB (e.g., encoding a 8 kHz bandwidth corresponding to a frequency range from 0 Hz to 8 kHz), the decoder may perform time domain bandwidth extension (BWE) techniques to smoothly transition from SWB to WB. In some examples, as further described herein, blind BWE may be used to effectuate the smooth transition. Performing error concealment operations and blind BWE operations may result in an increase in decoding complexity and an increased load on processing resources. However, it may be difficult to maintain performance when complexity increases.

The present disclosure describes systems and methods of error concealment with reduced complexity. In a particular aspect, one or more signals may be reused at a decoder when performing error concealment during a bandwidth transition period. By re-using the one or more signals, overall decoding complexity may be reduced as compared to conventional error concealment operations during bandwidth transition periods.

As used herein, a "bandwidth transition period" may span one or more frames of an audio signal including but not limited to frame(s) exhibiting relative variations in output bitrate, encoding bitrate, and/or source bitrate. As an illustrative non-limiting example, if received audio signal transitions from SWB to WB, then the bandwidth transition period in the received audio signal may include one or more SWB input frames, one or more WB input frames, and/or one or more intervening "roll-off" input frames having a bandwidth between SWB and WB. Similarly, with respect to output audio that is generated from the received audio signal, the bandwidth transition period may include one or more SWB output frames, one or more WB output frames, and/or one or more intervening "roll-off" output frames having a bandwidth between SWB and WB. Thus, operations described herein as occurring "during" a bandwidth transition period may occur at a leading "edge" of the bandwidth transition period where at least one of the frames is SWB, at a tailing "edge" of the bandwidth transition period where at least one of the frames is WB, or in the "middle" of the bandwidth transition period where at least one frame has a bandwidth between SWB and WB.

In some examples, error concealment for a frame that follows a NELP frame may be more complex than error concealment for a frame that follows an algebraic CELP (ACELP) frame. In accordance with the present disclosure, when the frame following a NELP frame is lost/corrupt during a bandwidth transition period, a decoder may re-use (e.g., copy) a signal that was generated during processing of the preceding NELP frame and that corresponds to a high-frequency portion of an output audio signal generated for the NELP frame. In a particular aspect, the re-used signal is an excitation signal or a synthesis signal corresponding to blind BWE performed for the NELP frame. These and other aspects of the present disclosure are further described with reference to the drawings, in which like reference numerals designate like, similar, and/or corresponding components.

Referring to FIG. 1, a particular aspect of a system that is operable to perform signal re-use during a bandwidth transition period is shown and generally designated 100. In a particular aspect, the system 100 may be integrated into a decoding system, apparatus, or electronic device. For example, the system 100 may be integrated into a wireless telephone or CODEC, as illustrative non-limiting examples. The system 100 includes an electronic device 110 that is configured to receive an encoded audio signal 102 and to generate output audio 150 corresponding to the encoded audio signal 102. The output audio 150 may correspond to an electrical signal or may be audible (e.g., output by a speaker).

It should be noted that in the following description, various functions performed by the system 100 of FIG. 1 are described as being performed by certain components or modules. However, this division of components and modules is for illustration only. In an alternate aspect, a function performed by a particular component or module may instead be divided amongst multiple components or modules. Moreover, in an alternate aspect, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The electronic device 110 may include a buffering module 112. The buffering module 112 may correspond to volatile or non-volatile memory (e.g., a de-jitter buffer in some examples) that is used to store frames of a received audio signal. For example, frames of the encoded audio signal 102 may be stored in the buffering module 112, and may be subsequently retrieved from the buffering module 112 for processing. Certain networking protocols enable frames to arrive at the electronic device 110 out of order. When frames arrive out of order, the buffering module 112 may be used for temporary storage of the frames and may support in-order retrieval of frames for subsequent processing. It should be noted that the buffering module 112 is optional and may not be included in alternative examples. To illustrate, the buffering module 112 may be included in one or more packet-switched implementations and may be excluded in one or more circuit-switched implementations.

In a particular aspect, the encoded audio signal is 102 is encoded using BWE techniques. According to the BWE extension techniques, a majority of the bits in each frame of the encoded audio signal 102 may be used to represent a low-band core information and may be decoded by a low-band core decoder 114. To reduce frame size, an encoded high-band portion of the encoded audio signal 102 may not be transmitted. Instead, frames of the encoded audio signal 102 may include high-band parameters that can be used by a high-band BWE decoder 116 to predicatively reconstruct the high-band portion of the encoded audio signal 102 using signal modeling techniques. In some aspects, the electronic device 110 may include multiple low-band core decoders and/or multiple high-band BWE decoders. For example, different frames of the encoded audio signal 102 may be decoded by different decoders depending on the frame type of the frames. In an illustrative example, the electronic device 110 includes decoder(s) configured to decode NELP frames, ACELP frames, and other types of frames. Alternatively, or in addition, components of the electronic device 110 may perform different operations depending on a bandwidth of the encoded audio signal 102. To illustrate, in the case of WB, the low-band core decoder 114 may operate in 0 Hz-6.4 kHz and the high-band BWE decoder may operate in 6.4-8 kHz. In the case of SWB, the low-band core decoder 114 may operate in 0 Hz-6.4 kHz and the high-band BWE decoder may operate in 6.4 kHz-16 kHz. Additional operations associated with low-band core decoding and high-band BWE decoding are further described with reference to FIG. 2.

In a particular aspect, the electronic device 110 also includes a bandwidth transition compensation module 118. The bandwidth transition compensation module 118 may be used to smooth bandwidth transitions in the encoded audio signal. To illustrate, the encoded audio signal 102 includes frames having a first bandwidth (shown in FIG. 1 using a crosshatch pattern) and frames having a second bandwidth that is less than the first bandwidth. When the bandwidth of the encoded audio signal 102 changes, the electronic device 110 may perform a corresponding change in decoding bandwidth. During a bandwidth transition period that follows a bandwidth transition, the bandwidth transition compensation module 118 may be used to enable a smooth bandwidth transition and reduce audible artifacts in the output audio 150, as further described herein.

The electronic device 110 further includes a synthesis module 140. As frames of the encoded audio signal 102 are decoded, the synthesis module 140 may receive audio data from the low-band core decoder 114 and the high-band BWE decoder 116. During bandwidth transition periods, the synthesis module 140 may additionally receive audio data from the bandwidth transition compensation module 118.

The synthesis module 140 may combine the received audio data for each frame of the encoded audio signal 102 to generate the output audio 150 corresponding to that frame of the encoded audio signal 102.

Figure 3:
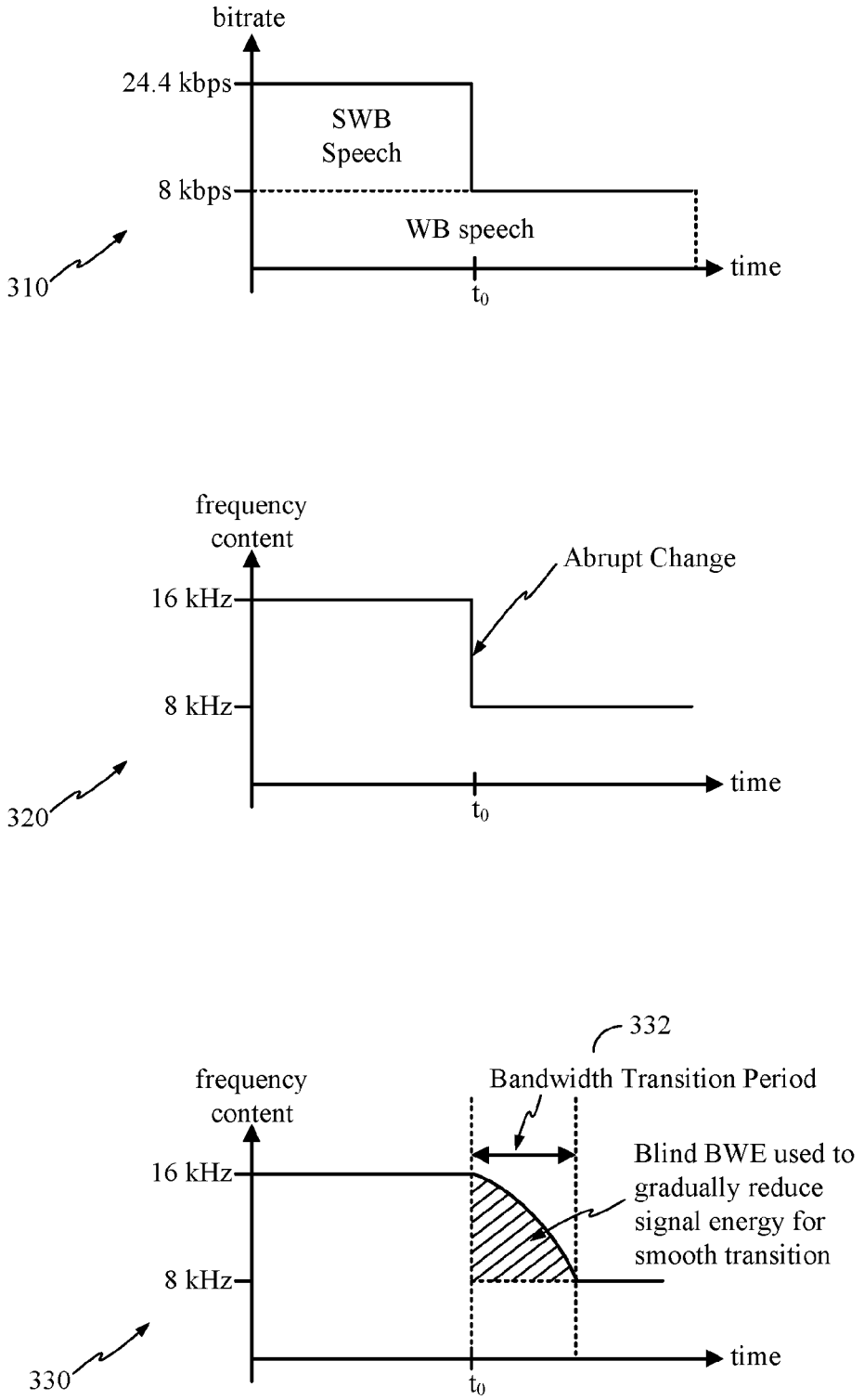
FIG. 3 illustrates a particular example of bandwidth transition in an encoded audio signal.

During operation, the electronic device 110 may receive the encoded audio signal 102 and decode the encoded audio signal 102 to generate the output audio 150. During the decoding of the encoded audio signal 102, the electronic device 110 may determine that a bandwidth transition has occurred. In the example of FIG. 1, a bandwidth reduction is shown. Examples of bandwidth reductions include, but are not limited to, FB to SWB, FB to WB, FB to NB, SWB to WB, SWB to NB, and WB to NB. FIG. 3 illustrates signal waveforms (not necessarily to scale) corresponding to such a bandwidth reduction. In particular, a first waveform 310 illustrates that at a time $t_0$, an encoding bitrate of the encoded audio signal 102 decreases from 24.4 kbps SWB speech to 8 kbps WB speech.

In particular aspects, different bandwidth may support different encoding bitrates. As an illustrative non-limiting example, a NB signal may be encoded at 5.9, 7.2, 8.0, 9.6, 13.2, 16.4, or 24.4 kbps. A WB signal may be encoded at 5.9, 7.2, 8.0, 9.6, 13.2, 16.4, 24.4, 32, 48, 64, 96, or 128 kbps. A SWB signal may be encoded at 9.6, 13.2, 16.4, 24.4, 32, 48, 64, 96, or 128 kbps. A FB signal may be encoded at 16.4, 24.4, 32, 48, 64, 96, or 128 kbps.

A second waveform 320 illustrates that reduction in encoding bitrate corresponds to an abrupt change in bandwidth from 16 kHz to 8 kHz at the time $t_0$. The abrupt change in bandwidth may result in noticeable artifacts in the output audio 150. To reduce such artifacts, as shown with respect to a third waveform 330, the bandwidth transition compensation module 118 may be used during a bandwidth transition period 332 to generate progressively less signal energy in the 8-16 kHz frequency and provide a relatively smooth transition from SWB speech to WB speech. Thus, in particular scenarios, the electronic device 110 may decode a received frame and determine whether or not to additionally perform blind BWE based on whether a bandwidth transition has occurred in the preceding (or previous) N frames (where N is an integer greater than or equal to 1). If a bandwidth transition has not occurred in the preceding (or previous) N frames, the electronic device 110 may output audio for the decoded frame. If a bandwidth transition has occurred in the previous N frames, the electronic device may perform blind BWE and output both the audio for the decoded frame as well as the blind BWE output. Blind BWE operations described herein may alternatively be referred to as "bandwidth transition compensation." It is to be noted that bandwidth transition compensation may not include a "full" blind BWE—certain parameters (e.g., WB parameters) can be reused to perform guided decoding (e.g., SWB decoding) that addresses an abrupt bandwidth transition (e.g., from SWB to WB).

In some examples, one or more frames of the encoded audio signal 102 may be erroneous. As used herein, a frame is considered erroneous if the frame is "lost" (e.g., not received by the electronic device 110), is corrupted (e.g., includes greater than a threshold number of bit errors), or is unavailable in the buffering module 112 when a decoder attempts to retrieve the frame (or a portion thereof). In circuit-switched implementations that exclude the buffering module 112, a frame may be considered erroneous if the frame is lost or includes more than a threshold number of bit errors. According to a particular aspect, when a frame is erroneous, the electronic device 110 may perform error concealment for the erroneous frames. For example, if an Nth frame is successfully decoded but a sequential next (N+1)th frame is erroneous, error concealment for the (N+1) th frame may be based on the decoding operations and output performed for the Nth frame. In a particular aspect, different error concealment operations are performed if the Nth frame was a NELP frame than if the Nth frame was an ACELP frame. Thus, in some examples, error concealment for a frame may be based on a frame type of a preceding frame. Error concealment operations for an erroneous frame may include predicting low-band core and/or high-band BWE data based on the low-band core and/or high-band BWE data of the previous frame.

Error concealment operations may also include, during a transition period, performing blind BWE that includes estimating LP coefficient (LPC) values, LSF values, frame energy parameters (e.g., gain frame values), temporal shaping values (e.g., gain shape values), etc. for a second frequency band based on the predicted low-band core and/or high-band BWE for the erroneous frame. Alternatively, such data, which may include LPC values, LSF values, frame energy parameters (e.g., gain frame values), temporal shaping parameters (e.g., gain shape values), etc., may be selected from a set of fixed values. In some examples, error concealment includes increasing LSP spacing and/or LSF spacing for an erroneous frame relative to the previous frame. Alternatively, or in addition, during a bandwidth transition period, error concealment may include reducing high-frequency signal energy (e.g., via adjustment of gain frame values) on a frame-by-frame basis to fade out the signal energy in the frequency band for which blind BWE is performed. In particular aspects, smoothing (e.g., overlap and add operations) may be performed at frame boundaries during a bandwidth transition period.

In the example of FIG. 1, a second frame 106, which sequentially follows a first frame 104*a* or 104*b*, is designated as being erroneous (e.g., "lost"). As shown in FIG. 1, the first frame may have a different bandwidth than the erroneous second frame 106 (e.g., as shown with respect to the first frame 104*a*), or may have the bandwidth as the erroneous second frame 106 (e.g., as shown with respect to the first frame 104*b*). Moreover, the erroneous second frame 106 is part of a bandwidth transition period. Thus, error concealment operations for the second frame 106 may not only include generating low-band core data and high-band BWE data, but may additionally include generating blind BWE data to continue the energy smoothing operation described with reference to FIG. 3. In some cases, performing both error concealment and blind BWE operations may increase decoding complexity at the electronic device 110 beyond a complexity threshold. For example, if the first frame is a NELP frame, the combination of NELP error concealment for the second frame 106 and blind BWE for the second frame 106 may increase the decoding complexity beyond the complexity threshold.

In accordance with the present disclosure, to reduce decoding complexity for the erroneous second frame 106, the bandwidth transition compensation module 118 may selectively re-use a signal 120 that was generated while performing blind BWE for the preceding frame 104. For example, the signal 120 may be re-used when the preceding frame 104 has a particular coding type, such as NELP, although it is to be understood that in alternative examples the signal 120 may be re-used when the preceding frame 104 has another frame type. The re-used signal 120 may be a synthesis output, such as a synthesized signal, or an excitation signal that is used to generate the synthesis output. Re-using the signal 120 that was generated during blind BWE for the preceding frame 104 may be less complex than generating such a signal "from scratch" for the erroneous second frame 106, which may enable reducing overall decoding complexity for the second frame 106 to less than the complexity threshold.

In a particular aspect, during bandwidth transition periods, output from the high-band BWE decoder 116 may be disregarded or may not be generated during. Instead, the bandwidth transition compensation module 118 may generate audio data that spans both the high-band BWE frequency band (for which bits are received in the encoded audio signal 102) as well as the bandwidth transition compensation (e.g., blind BWE) frequency band. To illustrate, in the case of a SWB to WB transition, audio data 122, 124 may represent the 0 Hz-6.4 kHz low-band core and audio data 132, 134 may represent the 6.4 kHz-8 kHz high-band BWE and the 8 kHz-16 kHz bandwidth transition compensation frequency band (or a portion thereof).

Thus, in a particular aspect, decoding operations for the first frame 104 (e.g., the first frame 104*b*) and the second frame 106 may be as follows. For the first frame 104, the low-band core decoder 114 may generate audio data 122 corresponding to a first frequency band (e.g., 0-6.4 kHz in the case of WB) of the first frame 104. The bandwidth transition compensation module 118 may generate audio data 132 corresponding to a second frequency band of the first frame 104, which may include a high-band BWE frequency band (e.g., 6.4 kHz-8 kHz in the case of WB) and all or a portion of a blind BWE (or bandwidth transition compensation) frequency band (e.g., 8-16 kHz in the case of a transition from SWB to WB). During generation of the audio data 132, the bandwidth transition compensation module 118 may generate the signal 120 based at least in part on blind BWE operations and may store the signal 120 (e.g., in a decoding memory). In a particular aspect, the signal 120 is generated based at least in part on the audio data 122. Alternatively, or in addition, the signal 120 may be generated based at least in part on non-linearly extending an excitation signal corresponding to the first frequency band of the first frame 104. The synthesis module 140 may combine the audio data 122, 132 to generate the output audio 150 for the first frame 104.

For the erroneous second frame 106, if the first frame 104 was a NELP frame, the low-band core decoder 114 may perform NELP error concealment to generate audio data 124 corresponding to the first frequency band of the second frame 106. In addition, the bandwidth transition compensation module 118 may re-use the signal 120 to generate audio data 134 corresponding to the second frequency band of the second frame 106. Alternatively, if the first frame was an ACELP (or other non-NELP) frame, the low-band core decoder 114 may perform ACELP (or other) error concealment to generate the audio data 124, and high-band BWE decoder 116 and the bandwidth transition compensation module 118 may generate the audio data 134 without re-using the signal 120. The synthesis module 140 may combine the audio data 124, 134 to generate the output audio 150 for the erroneous second frame 106.

The above operations may be represented using the following illustrative, non-limiting pseudocode example:

```
/*Note: Synthesis for first frequency band may include low-band core decoding along
with any high-band BWE extension layer that uses the bits from the (previously)
received frame. Blind BWE may be used to generate a high-band synthesis for the
second frequency band when in a bandwidth transition period*/
/*Decoding for first frequency band (also applies for "normal" non-bandwidth transition
periods)*/
if (current frame is not erroneous)
{
  if (coding type of current frame == TYPE-A)
  {// e.g., TYPE-A == ACELP
    do TYPE-A decoding
    generate audio data for first frequency band of current frame
  }
  else if (coding type of current frame == TYPE-B)
  {//e.g., TYPE-B == NELP
    do TYPE-B decoding
    generate audio data for first frequency band of current frame
  }
}
else if (current frame is erroneous)
{//e.g., current frame not received, corrupt, and/or unavailable in de-jitter buffer
  if (coding type of previous frame == TYPE-A)
  {
    do TYPE-A concealment
    generate audio data for first frequency band of current frame
  }
  else if (coding type of previous frame == TYPE-B)
  {
    do TYPE-B concealment
    generate audio data for first frequency band of current frame
  }
}
/*Decoding for second frequency band, including blind BWE during transition period*/
if (in a bandwidth transition period)
{
  if (current frame is not erroneous)
  {
    do BWE/blind BWE to synthesize audio data for second frequency band
      of current frame
  }
  else if (current frame is erroneous)
  {
    if (coding type of previous frame == TYPE-A)
```

-continued

```
      {
        do BWE/blind BWE to synthesize audio data for second frequency band of current
          frame
      }
      else if (coding type of previous frame == TYPE-B)
      {
        re-use (e.g., copy) signal(s) from previous blind BWE (e.g., generated based on
          the TYPE-B low-band core in the previous frame)
      }
    }
    Add and Output audio data for first frequency band + audio data for second
      frequency band
}
else if (not in a bandwidth transition period)
}
  /*Perform "normal" operations to produce output audio data for second frequency
band (if present in audio signal)
}
```

The system 100 of FIG. 1 thus enables re-using the signal 120 during a bandwidth transition period. Re-using the signal 120 instead of performing blind BWE "from scratch" may reduce decoding complexity at the electronic device, such as, for example, in the case where the signal 120 is re-used when performing blind BWE for an erroneous frame that sequentially follows a NELP frame.

Although not shown in FIG. 1, in some examples the electronic device 110 may include additional components. For example, the electronic device 110 may include a front-end bandwidth detector configured to receive the encoded audio signal 102 and to detect bandwidth transitions in the encoded audio signal. As another example, the electronic device 110 may include a pre-processing module, such as a filter bank, that is configured to separate (e.g., partition and route) frames of the encoded audio signal 102 based on frequency. To illustrate, in the case of a WB signal, the filter bank may separate frames of the audio signal into low-band core and high-band BWE components. Depending on implementation, the low-band core and high-band BWE components may have equal or unequal bandwidths, and/or may be overlapping or non-overlapping. Overlapping of low-band and high-band components may enable smooth blending of data/signals by the synthesis module 140, which may result in fewer audible artifacts in the output audio 150.

Figure 2:
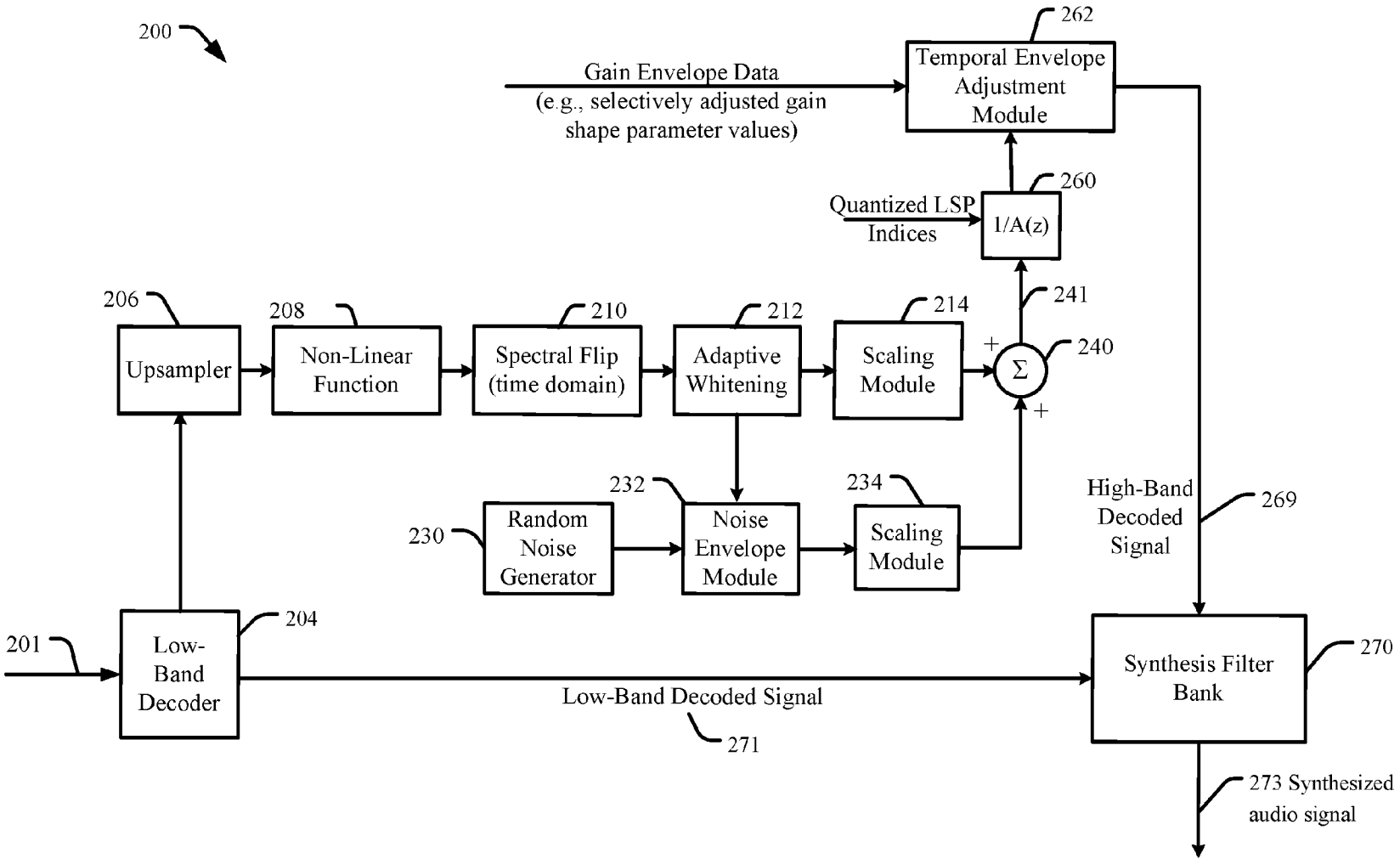
FIG. 2 is a diagram to illustrate another particular aspect of a system that is operable to perform signal re-use during a bandwidth transition period.

FIG. 2 depicts a particular aspect of a decoder 200 that can be used to decode an encoded audio signal, such as the encoded audio signal 102 of FIG. 1. In an illustrative example, the decoder 200 corresponds to the decoders 114, 116 of FIG. 1.

The decoder 200 includes a low-band decoder 204, such as an ACELP core decoder, that receives an input signal 201. The input signal 201 may include first data (e.g., an encoded low-band excitation signal and quantized LSP indices) corresponding to a low-band frequency range. The input signal 201 may also include second data (e.g., gain envelope data and quantized LSP indices) corresponding to a high-band BWE frequency band. Gain envelope data may include gain frame values and/or gain shape values. In a particular example, each frame of the input signal 201 is associated with one gain frame value and multiple (e.g., 4) gain shape values that are selected during encoding to limit variability/dynamic range when has little or no content is present in a high-band portion of a signal.

The low-band decoder 204 may be configured to generate a synthesized low-band decoded signal 271. High-band BWE synthesis may include providing a low-band excitation signal (or a representation thereof, such as a quantized version thereof) to an upsampler 206. The upsampler 206 may provide an upsampled version of the excitation signal to a non-linear function module 208 for generation of a bandwidth-extended signal. The bandwidth-extended signal may input into a spectral flip module 210 that performs time-domain spectrum mirroring on the bandwidth extended signal to generate a spectrally flipped signal.

The spectrally flipped signal may be input to an adaptive whitening module 212, which may flatten a spectrum of the spectrally flipped signal. The resulting spectrally flattened signal may be input into a scaling module 214 for generation of a first scaled signal that is input into a combiner 240. The combiner 240 may also receive an output of a random noise generator 230 that has been processed according to a noise envelope module 232 (e.g., a modulator) and a scaling module 234. The combiner 240 may generate a high-band excitation signal 241 that is input to a synthesis filter 260. In a particular aspect, the synthesis filter 260 is configured according to quantized LSP indices. The synthesis filter 260 may generate a synthesized high-band signal that is input into a temporal envelope adjustment module 262. The temporal envelope adjustment module 262 may adjust a temporal envelope of the synthesized high-band signal by applying gain envelope data, such as one or more gain shape values, to generate a high-band decoded signal 269 that is input into a synthesis filter bank 270.

The synthesis filter bank 270 may generate a synthesized audio signal 273, such as a synthesized version of the input signal 201, based on a combination of the low-band decoded signal 271 and the high-band decoded signal 269. The synthesized audio signal 273 may correspond to a portion of the output audio 150 of FIG. 1. FIG. 2 thus illustrates an example of operations that may be performed during decoding of a time-domain bandwidth extended signal, such as the encoded audio signal 102 of FIG. 1.

Although FIG. 2 illustrates an example of operation at the low-band core decoder 114 an the high-band BWE decoder 116, it is to be understood that one or more operations described with reference to FIG. 2 may also be performed by the bandwidth transition compensation module 118. For example, LSPs and temporal shaping information (e.g., gain shape values) can be substituted using preset values, and LSP separation can be gradually increased and high-frequency energy can be faded out (e.g., by adjusting gain frame values). Thus, the decoder 200, or at least components thereof, can be re-used for blind BWE by predicting parameters based on data transmitted in a bit stream (e.g., the input signal 201).

In a particular example, the bandwidth transition compensation module 118 may receive first parameter information from the low-band core decoder 114 and/or the high-band BWE decoder 116. The first parameters may be based on a "current frame" and/or one or more previously received frames. The bandwidth transition compensation module 118 may generate second parameters based on the first parameters, where the second parameters correspond to the second frequency band. In some aspects, the second parameters may be generated based on training audio samples. Alternatively, or in addition, the second parameters may be generated based on previous data generated at the electronic device 110. To illustrate, prior to the bandwidth transition in the encoded audio signal 102, the encoded audio signal 102 may be a SWB channel that includes an encoded low-band core spanning 0 Hz-6.4 kHz and a bandwidth-extended high-band spanning 6.4 kHz-16 kHz. Thus, before the bandwidth transition, the high-band BWE decoder 116 may have generated certain parameters corresponding to 8 kHz-16 kHz. In a particular aspect, during the bandwidth transition period caused by the change from 16 kHz to 8 kHz bandwidth, the bandwidth transition compensation module 118 may generate the second parameters, based at least in part on the 8 kHz-16 kHz parameters generated prior to the bandwidth transition period.

In some examples, a correlation between the first parameters and the second parameters may be determined based on correlation between low-band and high-band audio in audio training samples, and the bandwidth transition compensation module 118 may use the correlation to determine the second parameters. In alternative examples, the second parameters may be based on one or more fixed or default values. As another example, the second parameters may be determined based on predicted or analysis data, such as gain frame values, LSF values, etc. associated with previous frames of the encoded audio signal 102. As yet another example, an average LSF associated with the encoded audio signal 102 may indicate a spectral tilt, and the bandwidth transition compensation module 118 may bias the second parameters to more closely match the spectral tilt. The bandwidth transition compensation module 118 may thus support various methods of generating parameters for the second frequency range in "blind" fashion even when the encoded audio signal 102 does not include bits dedicated to the second frequency range (or a portion thereof).

It should be noted that although FIGS. 1 and 3 illustrate a bandwidth reduction, in alternative aspects, a bandwidth transition period may correspond to a bandwidth increase instead of a bandwidth reduction. For example, during decoding of an Nth frame, the electronic device 110 may determine that an (N+X)th frame in the buffering module 112 has higher bandwidth than the Nth frame. In response, during a bandwidth transition period corresponding to frames N, (N+1), (N+2), . . . (N+X−1), the bandwidth transition compensation module 118 may generate audio data to smooth an energy transition corresponding to the bandwidth increase. In some examples, a bandwidth reduction or a bandwidth reduction correspond to a decrease or increase in bandwidth of an "original" signal that is encoded by an encoder to generate the encoded audio signal 102.

Figure 4:
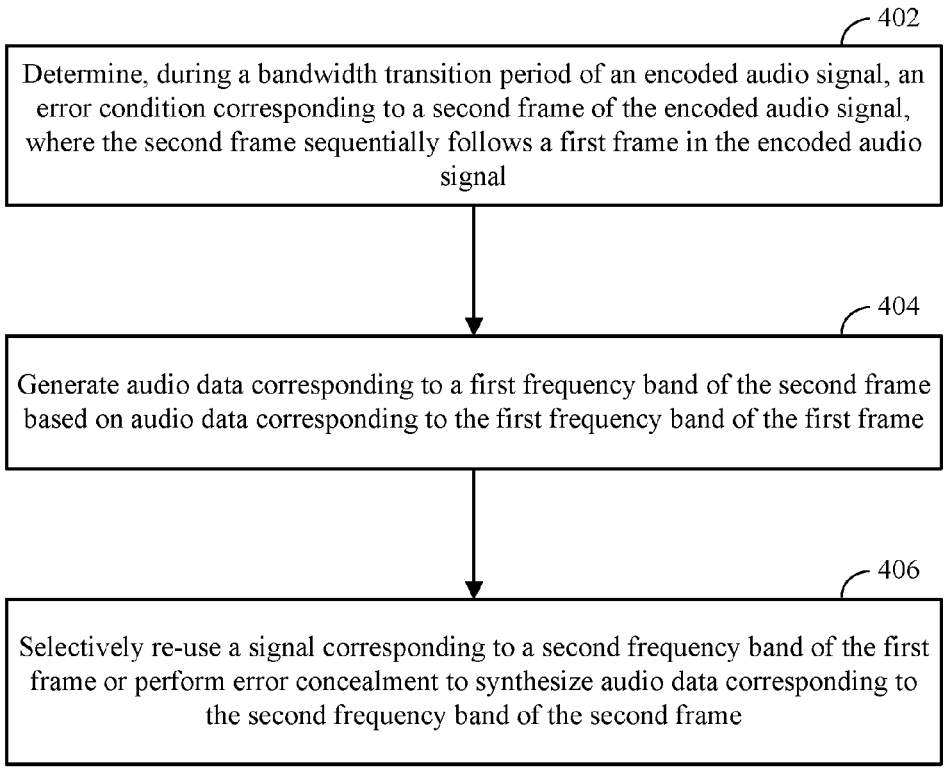
FIG. 4 is a diagram to illustrate a particular aspect of a method of operation at the system of FIG. 1.

Referring to FIG. 4, a particular aspect of a method of performing signal re-use during a bandwidth transition period is shown and generally designated 400. In an illustrative example, the method 400 may be performed at the system 100 of FIG. 1.

The method 400 may include determining, during a bandwidth transition period of an encoded audio signal, an error condition corresponding to a second frame of the encoded audio signal, at 402. The second frame may sequentially follow a first frame in the encoded audio signal. For example, referring to FIG. 1, the electronic device 110 may determine an error condition corresponding to the second frame 106, which follows the first frame 104 in the encoded audio signal 102. In a particular aspect, the sequence of frames is identified in or indicated by the frames. For example, each frame of the encoded audio signal 102 may include a sequence number, which may be used to reorder the frames if the frames are received out of order.

The method 400 may also include generating audio data corresponding to a first frequency band of the second frame based on audio data corresponding to the first frequency band of the first frame, at 404. For example, referring to FIG. 1, the low-band core decoder 114 may generate the audio data 124 corresponding to the first frequency band of the second frame 106 based on the audio data 122 corresponding to the first frequency band of the first frame 104. In a particular aspect, the first frame 104 is a NELP frame and the audio data 124 is generated based on performing NELP error concealment for the second frame 106 based on the first frame 104.

The method 400 may further include selectively (e.g., based on whether the first frame is an ACELP frame or a non-ACELP frame) re-using a signal corresponding to a second frequency band of the first frame or performing error concealment to synthesize audio data corresponding to the second frequency band of the second frame, at 406. In an illustrative aspect, a device may determine whether to perform signal re-use or high-frequency error concealment based on a coding mode or coding type of a previous frame. For example, referring to FIG. 1, in the case of a non-ACELP (e.g., NELP) frame, the bandwidth transition compensation module 118 may re-use the signal 120 to synthesize the audio data 134 corresponding to the second frequency band of the second frame 106. In a particular aspect, the signal 120 may have been generated at the bandwidth transition compensation module 118 during blind BWE operations performed for the first frame 104 during generation of the audio data 132 corresponding to the second frequency band of the first frame 104.

Figure 5:
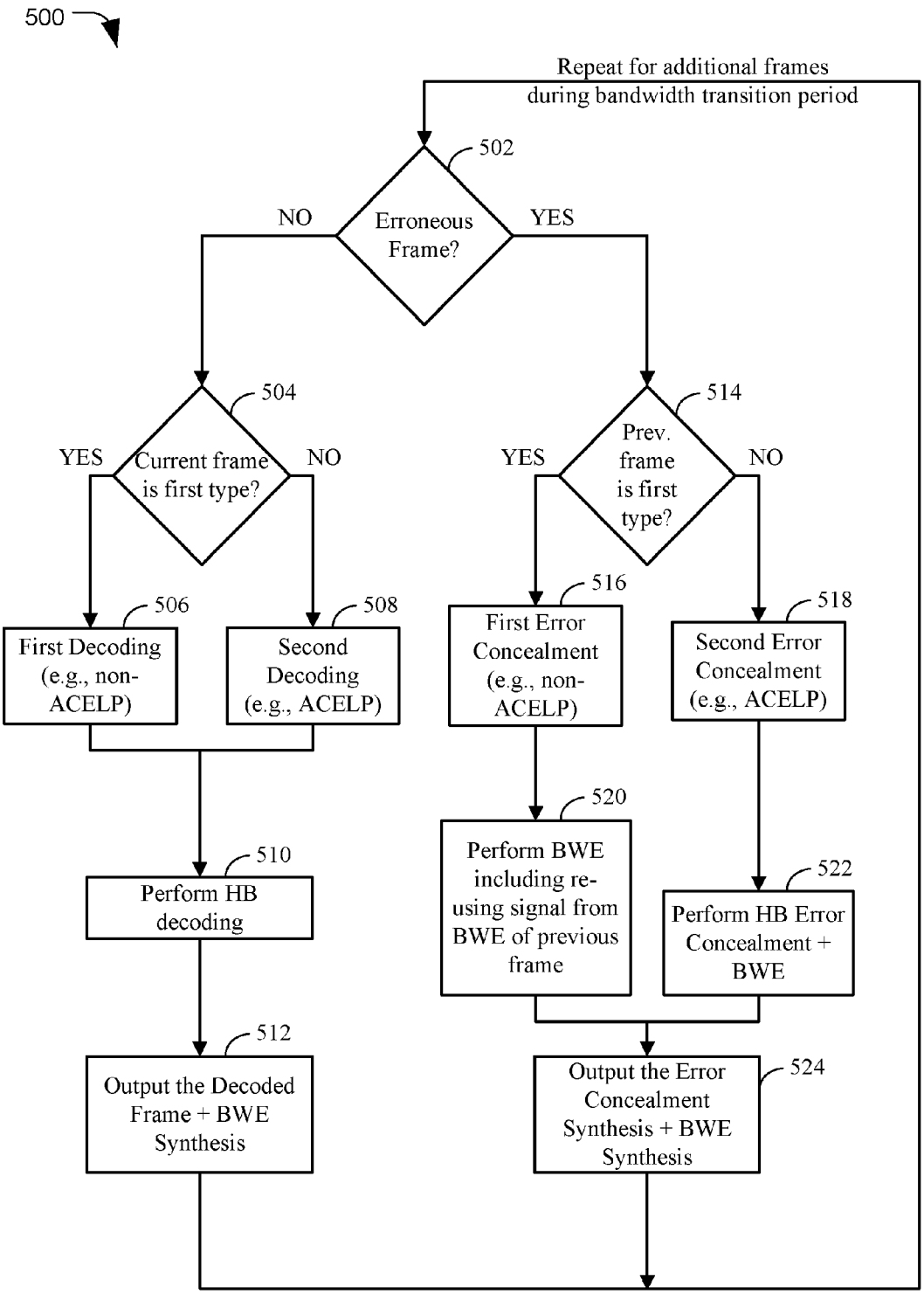
FIG. 5 is a diagram to illustrate a particular aspect of a method of operation at the system of FIG. 1.

Referring to FIG. 5, another particular aspect of a method of performing signal re-use during a bandwidth transition period is shown and generally designated 500. In an illustrative example, the method 500 may be performed at the system 100 of FIG. 1.

The method 500 corresponds to operations that may be performed during a bandwidth transition period. That is, given a "previous" frame in a particular coding mode, the method 500 of FIG. 5 may enable determining what error concealment and/or high-band synthesis operations should be performed if a "current" frame is erroneous. At 502, the method 500 includes determining whether a "current" frame being processed is erroneous. A frame may be considered erroneous if the frame is not received, is corrupted, or is unavailable for retrieval (e.g., from a de-jitter buffer). If the frame is not erroneous, the method 500 may include determining whether the frame has a first type (e.g., coding mode), at 504. For example, referring to FIG. 1, the electronic device 110 may determine that the first frame 104 is not erroneous, and then proceed to determine whether the first frame 104 is an ACELP frame.

If the frame is a non-ACELP (e.g., NELP) frame, the method 500 may include performing first (e.g., non-ACELP, such as NELP) decoding operations, at 506. For example, referring to FIG. 1, the low-band core decoder 114 and/or the high-band BWE decoder 116 may perform NELP decoding operations on the first frame 104 to generate the audio data 122. Alternatively, if the frame is an ACELP frame, the method 500 may include performing second decoding operations, such as ACELP decoding operations, at 508. For example, referring to FIG. 1, the low-band core decoder 114 may perform ACELP decoding operations to generate the audio data 122. In an illustrative aspect, the ACELP decoding operations may include one or more operations described with reference to FIG. 2.

The method 500 may include performing high-band decoding, at 510, and outputting a decoded frame and BWE synthesis, at 512. For example, referring to FIG. 1, the bandwidth transition compensation module 118 may generate the audio data 132, and the synthesis module 140 may output a combination of the audio data 122, 132 as the output audio 150 for the first frame 104. During generation of the audio data 132, the bandwidth transition compensation module 118 may generate the signal 120 (e.g., a synthesized signal or an excitation signal), which may be stored for subsequent re-use.

The method 500 may return to 502 and be repeated for additional frames during the bandwidth transition period. For example, referring to FIG. 1, the electronic device 110 may determine that the second frame 106 (which is now the "current" frame) is erroneous. When the "current" frame is erroneous, the method 500 may include determining whether a previous frame has the first type (e.g., coding mode), at 514. For example, referring to FIG. 1, the electronic device 110 may determine whether the previous frame 104 is an ACELP frame.

If the previous frame has the first type (e.g., is a non-ACELP frame, such as a NELP frame), the method 500 may include performing first (e.g., non-ACELP, such as NELP) error concealment, at 516, and performing BWE, at 520. Performing the BWE may include re-using a signal from the BWE of the previous frame. For example, referring to FIG. 1, the low-band core decoder 114 may perform NELP error concealment to generate the audio data 124, and the bandwidth transition compensation module 118 may re-use the signal 120 to generate the audio data 134.

If the previous frame does not have the first type (e.g., is an ACELP frame), the method 500 may include performing second error concealment, such as ACELP error concealment, at 518. When the previous frame is an ACELP frame, the method 500 may also include performing high-band error concealment and BWE (e.g., including bandwidth transition compensation), at 522, and may not include re-using a signal from BWE of a preceding frame. For example, referring to FIG. 1, the low-band core decoder 114 may perform ACELP error concealment to generate the audio data 124, and the bandwidth transition compensation module 118 may generate the audio data 134 without re-using the signal 120.

Advancing to 524, the method 500 may include outputting the error concealment synthesis and the BWE synthesis. For example, referring to FIG. 1, the synthesis module 140 may output a combination of the audio data 124, 134 as the output audio 150 for the second frame 106. The method 500 may then return to 502 and repeat for additional frames during the bandwidth transition period. The method 500 of FIG. 5 may thus enable handling of bandwidth transition period frames in the presence of errors. In particular, the method 500 of FIG. 5 may selectively perform error concealment, signal re-use, and/or bandwidth extension synthesis rather than relying on using roll-off to taper gain in all bandwidth transition scenarios, which may improve the quality of output audio generated from an encoded signal.

In particular aspects, the methods 400 and/or 500 may be implemented via hardware (e.g., a FPGA device, an ASIC, etc.) of a processing unit, such as a central processing unit (CPU), a DSP, or a controller, via a firmware device, or any combination thereof. As an example, the methods 400 and/or 500 can be performed by a processor that executes instructions, as described with respect to FIG. 6.

Figure 6:
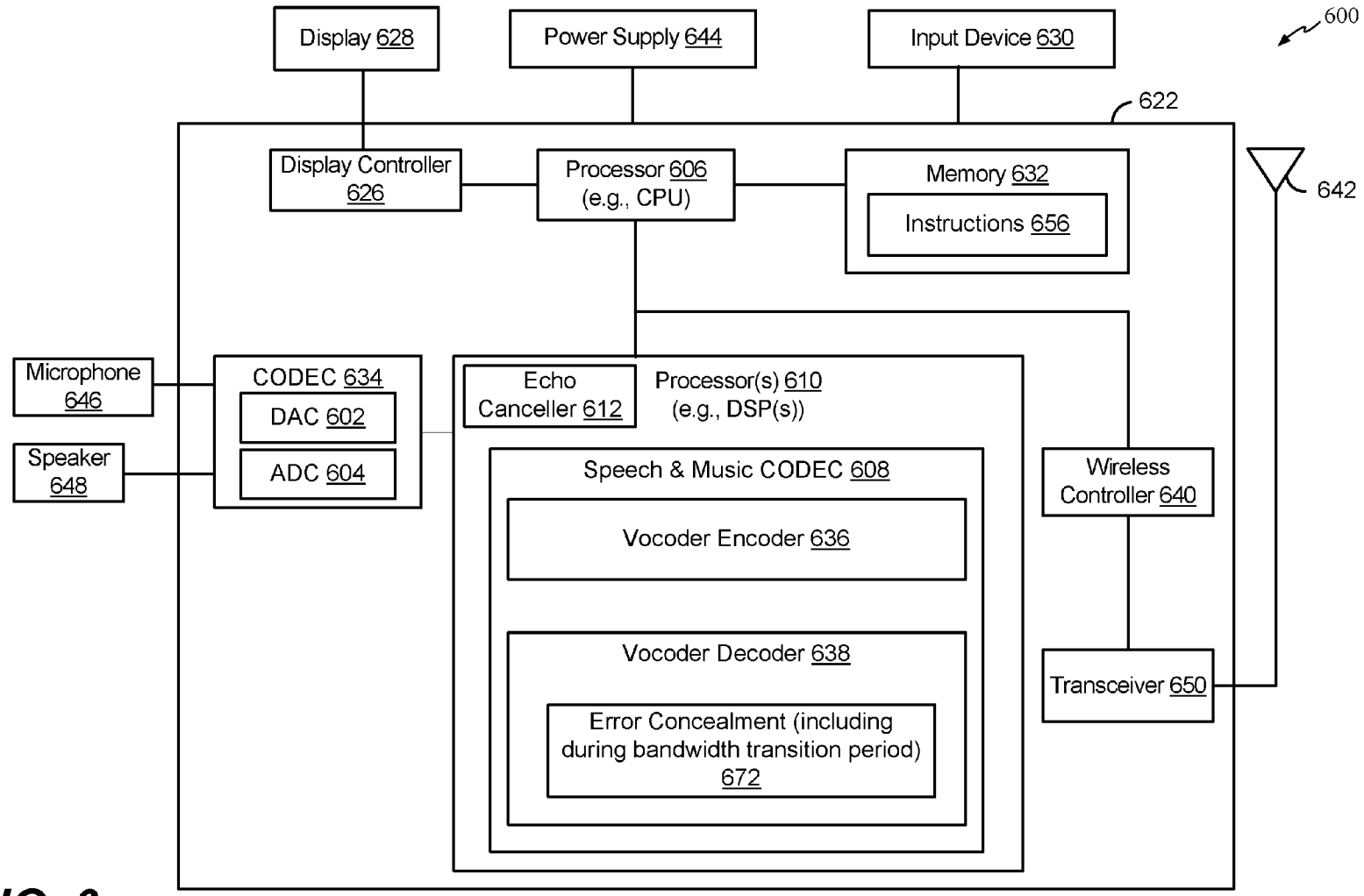
FIG. 6 is a block diagram of a wireless device operable to perform signal processing operations in accordance with the systems, apparatuses, and methods of FIGS. 1-5.

Referring to FIG. 6, a block diagram of a particular illustrative aspect of a device (e.g., a wireless communication device) is depicted and generally designated 600. In various aspects, the device 600 may have fewer or more components than illustrated in FIG. 6. In an illustrative aspect, the device 600 may correspond to one or more components of one or more systems, apparatus, or devices described with reference to FIGS. 1-2. In an illustrative aspect, the device 600 may operate according to one or more methods described herein, such as all or a portion of the methods 400 and/or 500.

In a particular aspect, the device 600 includes a processor 606 (e.g., a CPU). The device 600 may include one or more additional processors 610 (e.g., one or more DSPs). The processors 610 may include a speech and music CODEC 608 and an echo canceller 612. The speech and music CODEC 608 may include a vocoder encoder 636, a vocoder decoder 638, or both.

In a particular aspect, the vocoder decoder 638 may include error concealment logic 672. The error concealment logic 672 may be configured to re-use a signal during a bandwidth transition period. For example, the error concealment logic may include one or more components of the system 100 of FIG. 1 and/or the decoder 200 of FIG. 2. Although the speech and music CODEC 608 is illustrated as a component of the processors 610, in other aspects one or more components of the speech and music CODEC 608 may be included in the processor 606, the CODEC 634, another processing component, or a combination thereof.

The device 600 may include a memory 632 and a wireless controller 640 coupled to an antenna 642 via transceiver 650. The device 600 may include a display 628 coupled to a display controller 626. A speaker 648, a microphone 646, or both may be coupled to the CODEC 634. The CODEC 634 may include a digital-to-analog converter (DAC) 602 and an analog-to-digital converter (ADC) 604.

In a particular aspect, the CODEC 634 may receive analog signals from the microphone 646, convert the analog signals to digital signals using the ADC 604, and provide the digital signals to the speech and music CODEC 608, such as in a pulse code modulation (PCM) format. The speech and music CODEC 608 may process the digital signals. In a particular aspect, the speech and music CODEC 608 may provide digital signals to the CODEC 634. The CODEC 634 may convert the digital signals to analog signals using the DAC 602 and may provide the analog signals to the speaker 648.

The memory 632 may include instructions 656 executable by the processor 606, the processors 610, the CODEC 634, another processing unit of the device 600, or a combination thereof, to perform methods and processes disclosed herein, such as the methods of FIGS. 4-5. One or more components of described with reference to FIGS. 1-2 may be implemented via dedicated hardware (e.g., circuitry), by a processor executing instructions to perform one or more tasks, or a combination thereof. As an example, the memory 632 or one or more components of the processor 606, the processors 610, and/or the CODEC 634 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, an optically readable memory (e.g., a compact disc read-only memory (CD-ROM)), a solid-state memory, etc. The memory device may include instructions (e.g., the instructions 656) that, when executed by a computer (e.g., a processor in the CODEC 634, the processor 606, and/or the processors 610), may cause the computer to perform at least a portion of the methods of FIGS. 4-5. As an example, the memory 632 or the one or more components of the processor 606, the processors 610, the CODEC 634 may be a non-transitory computer-readable medium that includes instructions (e.g., the instructions 656) that, when executed by a computer (e.g., a processor in the CODEC 634, the processor 606, and/or the processors 610), cause the computer perform at least a portion of the methods of FIGS. 4-5.

In a particular aspect, the device 600 may be included in a system-in-package or system-on-chip device 622, such as a mobile station modem (MSM). In a particular aspect, the processor 606, the processors 610, the display controller 626, the memory 632, the CODEC 634, the wireless controller 640, and the transceiver 650 are included in a system-in-package or the system-on-chip device 622. In a particular aspect, an input device 630, such as a touchscreen and/or keypad, and a power supply 644 are coupled to the system-on-chip device 622. Moreover, in a particular aspect, as illustrated in FIG. 6, the display 628, the input device 630, the speaker 648, the microphone 646, the antenna 642, and the power supply 644 are external to the system-on-chip device 622. However, each of the display 628, the input device 630, the speaker 648, the microphone 646, the antenna 642, and the power supply 644 can be coupled to a component of the system-on-chip device 622, such as an interface or a controller. In an illustrative aspect, the device 600, or component(s) thereof, corresponds to, includes, or is included in a mobile communication device, a smartphone, a cellular phone, a base station, a laptop computer, a computer, a tablet computer, a personal digital assistant, a display device, a television, a gaming console, a music player, a radio, a digital video player, an optical disc player, a tuner, a camera, a navigation device, a decoder system, an encoder system, or any combination thereof.

In an illustrative aspect, the processors 610 may be operable to perform signal encoding and decoding operations in accordance with the described techniques. For example, the microphone 646 may capture an audio signal. The ADC 604 may convert the captured audio signal from an analog waveform into a digital waveform that includes digital audio samples. The processors 610 may process the digital audio samples. The echo canceller 612 may reduce an echo that may have been created by an output of the speaker 648 entering the microphone 646.

The vocoder encoder 636 may compress digital audio samples corresponding to a processed speech signal and may form a transmit packet or frame (e.g. a representation of the compressed bits of the digital audio samples). The transmit packet may be stored in the memory 632. The transceiver 650 may modulate some form of the transmit packet (e.g., other information may be appended to the transmit packet) and may transmit the modulated data via the antenna 642.

As a further example, the antenna 642 may receive incoming packets that include a receive packet. The receive packet may be sent by another device via a network. For example, the receive packet may correspond to at least a portion of the encoded audio signal 102 of FIG. 1. The vocoder decoder 638 may decompress and decode the receive packet to generate reconstructed audio samples (e.g., corresponding to the output audio 150 or the synthesized audio signal 273). When a frame error occurs during a bandwidth transition period, the error concealment logic 672 may selectively re-use one or more signals for blind BWE, as described with reference to the signal 120 of FIG. 1. The echo canceller 612 may remove echo from the reconstructed audio samples. The DAC 602 may convert an output of the vocoder decoder 638 from a digital waveform to an analog waveform and may provide the converted waveform to the speaker 648 for output.

Figure 7:
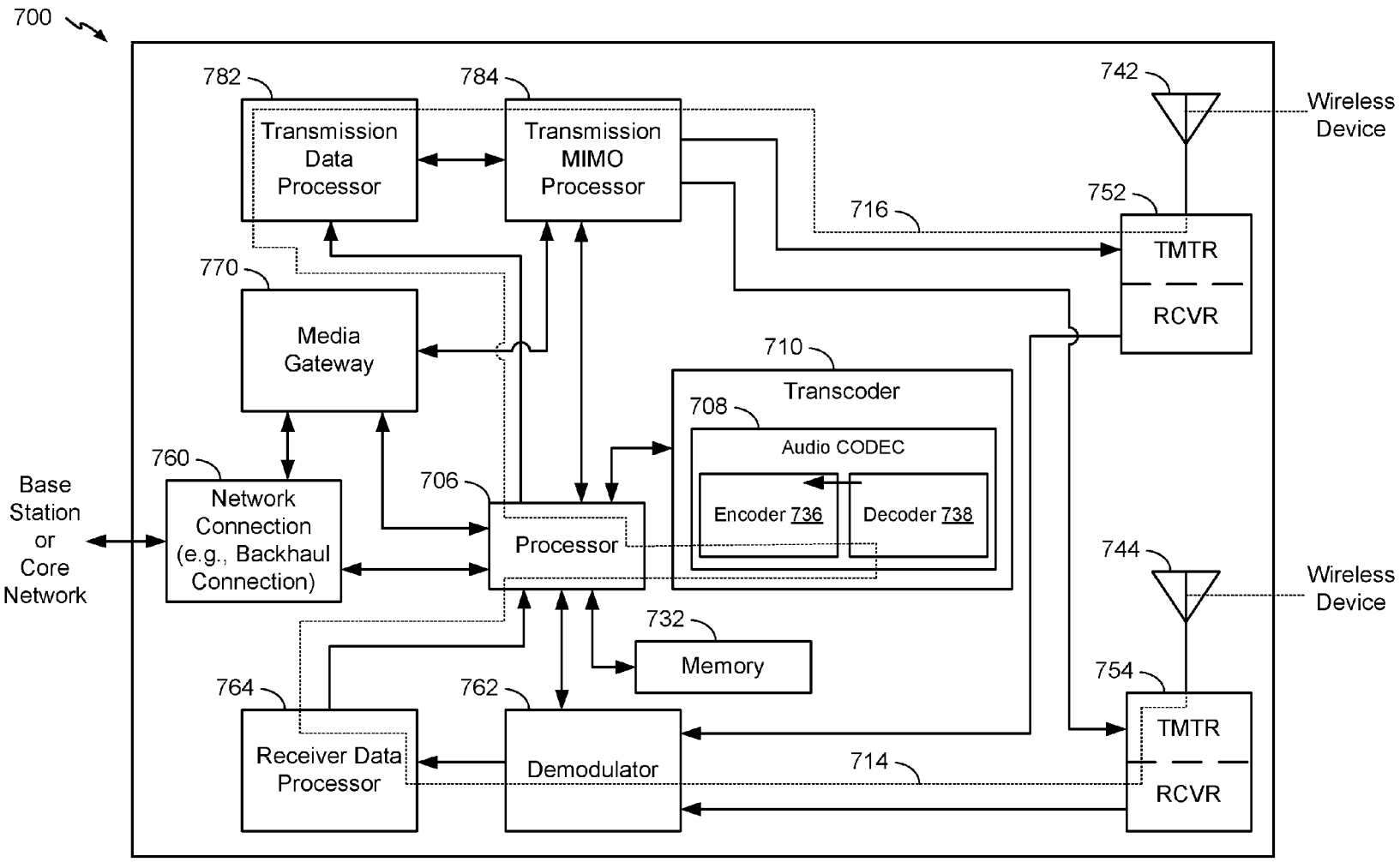
FIG. 7 is a block diagram of a base station operable to perform signal processing operations in accordance with the systems, apparatuses, and methods of FIGS. 1-5.

Referring to FIG. 7, a block diagram of a particular illustrative example of a base station 700 is depicted. In various implementations, the base station 700 may have more components or fewer components than illustrated in FIG. 7. In an illustrative example, the base station 700 may include the electronic device 110 of FIG. 1. In an illustrative example, the base station 700 may operate according to one or more of the methods of FIGS. 4-5.

The base station 700 may be part of a wireless communication system. The wireless communication system may include multiple base stations and multiple wireless devices. The wireless communication system may be a LTE system, a CDMA system, a GSM system, a wireless local area network (WLAN) system, or some other wireless system. A CDMA system may implement WCDMA, CDMA 1×, Evolution-Data Optimized (EVDO), TD-SCDMA, or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a BLUETOOTH (BLUETOOTH is a registered trademark of Bluetooth SIG, Inc. of Kirkland, Wash., USA) device, etc. The wireless devices may include or correspond to the device 600 of FIG. 6.

Various functions may be performed by one or more components of the base station 700 (and/or in other components not shown), such as sending and receiving messages and data (e.g., audio data). In a particular example, the base station 700 includes a processor 706 (e.g., a CPU). The base station 700 may include a transcoder 710. The transcoder 710 may include an audio (e.g., speech and music) CODEC 708. For example, the transcoder 710 may include one or more components (e.g., circuitry) configured to perform operations of the audio CODEC 708. As another example, the transcoder 710 may be configured to execute one or more computer-readable instructions to perform the operations of the audio CODEC 708. Although the audio CODEC 708 is illustrated as a component of the transcoder 710, in other examples one or more components of the audio CODEC 708 may be included in the processor 706, another processing component, or a combination thereof. For example, a decoder 738 (e.g., a vocoder decoder) may be included in a receiver data processor 764. As another example, an encoder 736 (e.g., a vocoder encoder) may be included in a transmission data processor 782.

The transcoder 710 may function to transcode messages and data between two or more networks. The transcoder 710 may be configured to convert message and audio data from a first format (e.g., a digital format) to a second format. To illustrate, the decoder 738 may decode encoded signals having a first format and the encoder 736 may encode the decoded signals into encoded signals having a second format. Additionally or alternatively, the transcoder 710 may be configured to perform data rate adaptation. For example, the transcoder 710 may downconvert a data rate or upconvert the data rate without changing a format the audio data. To illustrate, the transcoder 710 may downconvert 64 kilobit per second (kbit/s) signals into 16 kbit/s signals.

The audio CODEC 708 may include the encoder 736 and the decoder 738. The decoder 738 may include error concealment logic, as described with reference to FIG. 6.

The base station 700 may include a memory 732. The memory 732, such as a computer-readable storage device, may include instructions. The instructions may include one or more instructions that are executable by the processor 706, the transcoder 710, or a combination thereof, to perform one or more of the methods of FIGS. 4-5. The base station 700 may include multiple transmitters and receivers (e.g., transceivers), such as a first transceiver 752 and a second transceiver 754, coupled to an array of antennas. The array of antennas may include a first antenna 742 and a second antenna 744. The array of antennas may be configured to wirelessly communicate with one or more wireless devices, such as the device 600 of FIG. 6. For example, the second antenna 744 may receive a data stream 714 (e.g., a bit stream) from a wireless device. The data stream 714 may include messages, data (e.g., encoded speech data), or a combination thereof.

The base station 700 may include a network connection 760, such as backhaul connection. The network connection 760 may be configured to communicate with a core network or one or more base stations of the wireless communication network. For example, the base station 700 may receive a second data stream (e.g., messages or audio data) from a core network via the network connection 760. The base station 700 may process the second data stream to generate messages or audio data and provide the messages or the audio data to one or more wireless device via one or more antennas of the array of antennas or to another base station via the network connection 760. In a particular implementation, the network connection 760 may be a wide area network (WAN) connection, as an illustrative, non-limiting example. In some implementations, the core network may include or correspond to a PSTN, a packet backbone network, or both.

The base station 700 may include a media gateway 770 that is coupled to the network connection 760 and the processor 706. The media gateway 770 may be configured to convert between media streams of different telecommunications technologies. For example, the media gateway 770 may convert between different transmission protocols, different coding schemes, or both. To illustrate, the media gateway 770 may convert from PCM signals to Real-Time Transport Protocol (RTP) signals, as an illustrative, non-limiting example. The media gateway 770 may convert data between packet switched networks (e.g., a Voice Over Internet Protocol (VoIP) network, an IP Multimedia Subsystem (IMS), a fourth generation (4G) wireless network, such as LTE, WiMax, and ultra mobile broadband (UMB), etc.), circuit switched networks (e.g., a PSTN), and hybrid networks (e.g., a second generation (2G) wireless network, such as GSM, (general packet radio service (GPRS), and enhanced data rates for global evolution (EDGE), a 3G wireless network, such as WCDMA, EV-DO, and high speed packet access (HSPA), etc.).

Additionally, the media gateway 770 may include a transcoder configured to transcode data when codecs are incompatible. For example, the media gateway 770 may transcode between an Adaptive Multi-Rate (AMR) codec and a G.711 codec, as an illustrative, non-limiting example. The media gateway 770 may include a router and a plurality of physical interfaces. In some implementations, the media gateway 770 may also include a controller (not shown). In a particular implementation, the media gateway controller may be external to the media gateway 770, external to the base station 700, or both. The media gateway controller may control and coordinate operations of multiple media gateways. The media gateway 770 may receive control signals from the media gateway controller and may function to bridge between different transmission technologies and may add service to end-user capabilities and connections.

The base station 700 may include a demodulator 762 that is coupled to the transceivers 752, 754, the receiver data processor 764, and the processor 706, and the receiver data processor 764 may be coupled to the processor 706. The demodulator 762 may be configured to demodulate modulated signals received from the transceivers 752, 754 and to provide demodulated data to the receiver data processor 764. The receiver data processor 764 may be configured to extract a message or audio data from the demodulated data and send the message or the audio data to the processor 706.

The base station 700 may include a transmission data processor 782 and a transmission multiple input-multiple output (MIMO) processor 784. The transmission data processor 782 may be coupled to the processor 706 and the transmission MIMO processor 784. The transmission MIMO processor 784 may be coupled to the transceivers 752, 754 and the processor 706. In some implementations, the transmission MIMO processor 784 may be coupled to the media gateway 770. The transmission data processor 782 may be configured to receive the messages or the audio data from the processor 706 and to code the messages or the audio data based on a coding scheme, such as CDMA or orthogonal frequency-division multiplexing (OFDM), as an illustrative, non-limiting examples. The transmission data processor 782 may provide the coded data to the transmission MIMO processor 784.

The coded data may be multiplexed with other data, such as pilot data, using CDMA or OFDM techniques to generate multiplexed data. The multiplexed data may then be modulated (i.e., symbol mapped) by the transmission data processor 782 based on a particular modulation scheme (e.g., Binary phase-shift keying ("BPSK"), Quadrature phase-shift keying ("QPSK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 706.

The transmission MIMO processor 784 may be configured to receive the modulation symbols from the transmission data processor 782 and may further process the modulation symbols and may perform beamforming on the data. For example, the transmission MIMO processor 784 may apply beamforming weights to the modulation symbols. The beamforming weights may correspond to one or more antennas of the array of antennas from which the modulation symbols are transmitted.

During operation, the second antenna 744 of the base station 700 may receive a data stream 714. The second transceiver 754 may receive the data stream 714 from the second antenna 744 and may provide the data stream 714 to the demodulator 762. The demodulator 762 may demodulate modulated signals of the data stream 714 and provide demodulated data to the receiver data processor 764. The receiver data processor 764 may extract audio data from the demodulated data and provide the extracted audio data to the processor 706.

The processor 706 may provide the audio data to the transcoder 710 for transcoding. The decoder 738 of the transcoder 710 may decode the audio data from a first format into decoded audio data and the encoder 736 may encode the decoded audio data into a second format. In some implementations, the encoder 736 may encode the audio data using a higher data rate (e.g., upconvert) or a lower data rate (e.g., downconvert) than received from the wireless device. In other implementations the audio data may not be transcoded. Although transcoding (e.g., decoding and encoding) is illustrated as being performed by a transcoder 710, the transcoding operations (e.g., decoding and encoding) may be performed by multiple components of the base station 700. For example, decoding may be performed by the receiver data processor 764 and encoding may be performed by the transmission data processor 782. In other implementations, the processor 706 may provide the audio data to the media gateway 770 for conversion to another transmission protocol, coding scheme, or both. The media gateway 770 may provide the converted data to another base station or core network via the network connection 760.

The decoder 738, during a bandwidth transition period of an encoded audio signal, determine an error condition corresponding to a second frame of the encoded audio signal, where the second frame sequentially follows a first frame in the encoded audio signal. The decoder 738 may generate audio data corresponding to a first frequency band of the second frame based on audio data corresponding to the first frequency band of the first frame. The decoder 738 may re-use a signal corresponding to a second frequency band of the first frame to synthesize audio data corresponding to the second frequency band of the second frame. In some examples, the decoder may determine whether to perform high-band error concealment or signal re-use based on whether the first frame is an ACELP frame or a non-ACELP frame. Further, encoded audio data generated at the encoder 736, such as transcoded data, may be provided to the transmission data processor 782 or the network connection 760 via the processor 706.

The transcoded audio data from the transcoder 710 may be provided to the transmission data processor 782 for coding according to a modulation scheme, such as OFDM, to generate the modulation symbols. The transmission data processor 782 may provide the modulation symbols to the transmission MIMO processor 784 for further processing and beamforming. The transmission MIMO processor 784 may apply beamforming weights and may provide the modulation symbols to one or more antennas of the array of antennas, such as the first antenna 742 via the first transceiver 752. Thus, the base station 700 may provide a transcoded data stream 716, that corresponds to the data stream 714 received from the wireless device, to another wireless device. The transcoded data stream 716 may have a different encoding format, data rate, or both, than the data stream 714. In other implementations, the transcoded data stream 716 may be provided to the network connection 760 for transmission to another base station or a core network.

The base station 700 may therefore include a computer-readable storage device (e.g., the memory 732) storing instructions that, when executed by a processor (e.g., the processor 706 or the transcoder 710), cause the processor to perform operations according to one or more methods described herein, such as all or a portion of the methods 400 and/or 500.

In a particular aspect, an apparatus includes means for generating audio data corresponding to a first frequency band of a second frame based on audio data corresponding to the first frequency band of a first frame. The second frame sequentially follows the first frame according to a sequence of frames of an encoded audio signal during a bandwidth transition period. For example, the means for generating may include one or more components of the electronic device 110, such as the low-band core decoder 114, one or more components of the decoder 200, one or more components of the device 600 (e.g., the error concealment logic 672), another device, circuit, module, or logic configured to generate audio data, or any combination thereof. The apparatus also includes means, responsive to an error condition corresponding to the second frame, for re-using a signal corresponding to a second frequency band of the first frame to synthesize audio data corresponding to the second frequency band of the second frame. For example, the means for re-using may include one or more components of the electronic device 110, such as the bandwidth transition compensation module 118, one or more components of the decoder 200, one or more components of the device 600 (e.g., the error concealment logic 672), another device, circuit, module, or logic configured to generate audio data, or any combination thereof.

Those of skill would further appreciate that the various illustrative logical blocks, configurations, modules, circuits, and algorithm steps described in connection with the aspects disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the aspects disclosed herein may be embodied directly in hardware, in a software module executed by a processor, or in a combination of the two. A software module may reside in a memory device, such as RAM, MRAM, STT-MRAM, flash memory, ROM, PROM, EPROM, EEPROM, registers, hard disk, a removable disk, an optically readable memory (e.g., a CD-ROM), a solid-state memory, etc. An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed aspects is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein but is to be accorded the widest scope possible consistent with the principles and novel features as defined by the following claims.

What is claimed is:

1. A method comprising:

determining, at an electronic device during a bandwidth transition period of an encoded audio signal, an error condition corresponding to a second frame of the encoded audio signal, wherein the second frame sequentially follows a first frame in the encoded audio signal;

generating audio data corresponding to a first frequency band of the second frame based on audio data corresponding to the first frequency band of the first frame; and re-using a signal corresponding to a second frequency band of the first frame to synthesize audio data corresponding to the second frequency band of the second frame.

2. The method of claim 1, wherein, during the bandwidth transition period, re-using the signal reduces a signal energy of the encoded audio signal by smoothing a transition from a first frequency to a second frequency.

3. The method of claim 1, wherein the bandwidth transition period corresponds to a bandwidth reduction, and wherein the bandwidth reduction is from:

full band (FB) to super wideband (SWB);

FB to wideband (WB);

FB to narrowband (NB);

SWB to WB;

SWB to NB; or

WB to NB.

4. The method of claim 3, wherein the bandwidth reduction corresponds to at least one of a reduction in encoding bitrate or a reduction in bandwidth of a signal that is encoded to generate the encoded audio signal.

5. The method of claim 1, wherein the bandwidth transition period corresponds to a bandwidth increase.

6. The method of claim 1, wherein the first frequency band includes a low-band frequency band, and wherein, during the bandwidth transition period, the encoded audio signal transitions from a first frequency to a second frequency.

7. The method of claim 1, wherein the second frequency band includes a high-band bandwidth extension frequency band and a bandwidth transition compensation frequency band.

8. The method of claim 1, wherein the re-used signal corresponding to the second frequency band of the first frame is generated based at least in part on the audio data corresponding to the first frequency band of the first frame.

9. The method of claim 1, wherein the re-used signal corresponding to the second frequency band of the first frame is generated based at least in part on blind bandwidth extension.

10. The method of claim 1, wherein the re-used signal corresponding to the second frequency band of the first frame is generated based at least in part on non-linearly extending an excitation signal corresponding to the first frequency band of the first frame.

11. The method of claim 1, wherein at least one of line spectral pair (LSP) values, line spectral frequencies (LSF) values, frame energy parameters, or temporal shaping parameters corresponding to at least a portion of the second frequency band of the second frame is predicted based on the audio data corresponding to the first frequency band of the first frame.

12. The method of claim 1, wherein at least one of line spectral pair (LSP) values, line spectral frequencies (LSF) values, frame energy parameters, or temporal shaping parameters corresponding to at least a portion of the second frequency band of the second frame is selected from a set of fixed values.

13. The method of claim 1, wherein at least one of line spectral pair (LSP) spacing or line spectral frequencies (LSF) spacing is increased for the second frame relative to the first frame.

14. The method of claim 1, wherein the first frame is encoded using noise-excited linear prediction (NELP).

15. The method of claim 1, wherein the first frame is encoded using algebraic code-excited linear prediction (ACELP).

16. The method of claim 1, wherein the re-used signal comprises a synthesized signal.

17. The method of claim 1, wherein the re-used signal comprises an excitation signal.

18. The method of claim 1, wherein determining the error condition corresponds to determining that at least a portion of the second frame is not received by the electronic device, is corrupted, or is unavailable in a de-jitter buffer.

19. The method of claim 1, wherein energy of at least a portion of the second frequency band is reduced on a frame-by-frame basis during the bandwidth transition period to fade out signal energy corresponding to at least the portion of the second frequency band.

20. The method of claim 1, further comprising performing, for at least a portion of the second frequency band, smoothing at frame boundaries during the bandwidth transition period.

21. The method of claim 1, wherein the electronic device comprises a mobile communication device.

22. The method of claim 1, wherein the electronic device comprises a base station.

23. The method of claim 1, further comprising combining the audio data corresponding to the first frequency band of the second frame and the synthesized audio data corresponding to the second frequency band of the second frame to generate output audio for the second frame.

24. The method of claim 1, wherein determining the error condition corresponds to determining that an entirety of the second frame is not received by the electronic device.

25. The method of claim 1, further comprising determining whether to re-use the signal corresponding to the second frequency band of the first frame based on an encoder type of a previous frame.

26. An apparatus comprising:

a decoder configured to generate, during a bandwidth transition period of an encoded audio signal, audio data corresponding to a first frequency band of a second frame of the encoded audio signal based on audio data corresponding to the first frequency band of a first frame of the encoded audio signal, wherein the second frame sequentially follows the first frame in the encoded audio signal; and bandwidth transition compensation circuitry configured, in response to an error condition corresponding to the second frame, to re-use a signal corresponding to a second frequency band of the first frame to synthesize audio data corresponding to the second frequency band of the second frame.

27. The apparatus of claim 26, wherein the decoder comprises a low-band core decoder, and further comprising a high-band bandwidth extension decoder configured to determine the re-used signal.

28. The apparatus of claim 26, further comprising a de-jitter buffer.

29. The apparatus of claim 26, further comprising synthesis circuitry configured to generate:

first output audio corresponding to the first frame based on the audio data corresponding to the first frequency band of the first frame and the signal corresponding to the second frequency band of the first frame; and second output audio based on the audio data corresponding to the first frequency band of the second frame and the synthesized audio data corresponding to the second frequency band of the second frame.

30. The apparatus of claim 26, further comprising:

an antenna; and a receiver coupled to the antenna and configured to receive the encoded audio signal.

31. The apparatus of claim 30, wherein the decoder, the bandwidth transition compensation circuitry, the antenna, and the receiver are integrated into a mobile communication device.

32. The apparatus of claim 30, wherein the decoder, the bandwidth transition compensation circuitry, the antenna, and the receiver are integrated into a base station.

33. An apparatus comprising:

means for generating, during a bandwidth transition period of an encoded audio signal, audio data corresponding to a first frequency band of a second frame of the encoded audio signal based on audio data corresponding to the first frequency band of a first frame of the encoded audio signal, wherein the second frame sequentially follows the first frame in the encoded audio signal; and means, responsive to an error condition corresponding to the second frame, for re-using a signal corresponding to a second frequency band of the first frame to synthesize audio data corresponding to the second frequency band of the second frame.

34. The apparatus of claim 33, wherein the first frequency band includes a low-band frequency band and wherein the second frequency band includes a high-band bandwidth extension frequency band and a bandwidth transition compensation frequency band.

35. The apparatus of claim 33, wherein the means for generating and the means for re-using are integrated into a mobile communication device.

36. The apparatus of claim 33, wherein the means for generating and the means for re-using are integrated into a base station.

37. A non-transitory processor-readable medium comprising instructions that, when executed by a processor, cause the processor to perform operations including:

determining, during a bandwidth transition period of an encoded audio signal, an error condition corresponding to a second frame of the encoded audio signal, wherein the second frame sequentially follows a first frame in the encoded audio signal;

generating audio data corresponding to a first frequency band of the second frame based on audio data corresponding to the first frequency band of the first frame; and re-using a signal corresponding to a second frequency band of the first frame to synthesize audio data corresponding to the second frequency band of the second frame.

38. The non-transitory processor-readable medium of claim 37, wherein the bandwidth transition period spans a plurality of frames of the encoded audio signal, wherein the plurality of frames includes at least one of the first frame of the second frame.

39. A method comprising:

determining, at an electronic device during a bandwidth transition period of an encoded audio signal, an error condition corresponding to a second frame of the encoded audio signal, wherein the second frame sequentially follows a first frame in the encoded audio signal;

generating audio data corresponding to a first frequency band of the second frame based on audio data corresponding to the first frequency band of the first frame; and determining, based on whether the first frame is an algebraic code-excited linear prediction (ACELP) frame or a non-ACELP frame, whether to perform high-band error concealment or re-use a signal corresponding to a second frequency band of the first frame to synthesize audio data corresponding to the second frequency band of the second frame.

40. The method of claim 39, wherein the non-ACELP frame is a noise-excited linear prediction (NELP) frame.

41. The method of claim 39, wherein the electronic device comprises a mobile communication device.

42. The method of claim 39, wherein the electronic device comprises a base station.

* * * * *